United States Patent [19]

Hashimoto

[11] 4,211,500

[45] Jul. 8, 1980

[54] TIP-PUSHED TYPE MECHANICAL PENCIL

[75] Inventor: Junichi Hashimoto, Saitama, Japan

[73] Assignee: Pentel Kabushiki Kaisha, Tokyo, Japan

[21] Appl. No.: 973,718

[22] Filed: Dec. 27, 1978

[30] Foreign Application Priority Data

Dec. 27, 1977 [JP] Japan ..... 52-156726

[51] Int. Cl.[2] ..... B43K 21/16

[52] U.S. Cl. ..... 401/65

[58] Field of Search ..... 401/65, 67, 80, 103

[56] References Cited

U.S. PATENT DOCUMENTS

| | | | |
|---|---|---|---|
| 3,850,531 | 11/1974 | Ackermann | 401/65 |
| 3,892,495 | 7/1975 | Narose et al. | 401/65 |
| 4,149,813 | 4/1979 | Katz et al. | 401/65 |

FOREIGN PATENT DOCUMENTS

| | | | |
|---|---|---|---|
| 49-42006 | 11/1974 | Japan | 401/65 |

*Primary Examiner*—John D. Yasko

*Attorney, Agent, or Firm*—Robert E. Burns; Emmanuel J. Lobato; Bruce L. Adams

[57] ABSTRACT

A tip-pushed type mechanical pencil permits a forward advance of a pencil lead by pressing the front end of the pencil against a writing surface and then releasing it. The mechanical pencil includes an outer cylinder in which an inner cylinder having a ferrule is fitted. The inner cylinder is normally urged by a first spring to cause the ferrule to project out of the front end of the outer cylinder. A control tube carrying a lead grasping packing is inserted within the inner cylinder. The control tube is urged toward the front end of the outer cylinder by a second spring. A chuck is received within the control tube, and is integrally connected with a lead passage tube which extends through the inner cylinder. The chuck cooperates with a chuck ring disposed within the control tube to grasp or release a lead. Both the chuck and the control tube are urged by a third spring in opposite directions. When the ferrule is pressed inward against the resilience of the first spring, the control tube retracts together with the inner cylinder, and when the force applied to the ferrule is released, the control tube moves toward the front end in delayed relationship with respect to the movement of the inner cylinder.

10 Claims, 14 Drawing Figures

TIP-PUSHED TYPE MECHANICAL PENCIL

FIELD AND BACKGROUND OF THE INVENTION

The invention relates to a push type mechanical pencil, and in particular, to a tip-pushed type mechanical pencil in which the lead is advanced as the tip is pressed against a writing surface.

A conventional push type mechanical pencil is provided with a knocked head at its rear end which may be pressed to advance the lead. A mechanical pencil of this type suffers from the disadvantage that the knocked head cannot be pressed unless the position of the hand of the person grasping the pencil is changed each time the lead is to be advanced. To avoid the need to change the person's hand position when the lead is to be advanced, there is proposed a so-called tip-pushed type mechanical pencil which is provided with a ferrule at the front end which may be displaced rearwardly against the resilience of a spring. When the ferrule is released after it is pressed against a writing surface, it is resiliently returned to permit an advance of the lead.

DESCRIPTION OF THE PRIOR ART

A tip-pushed type mechanical pencil is disclosed in detail, for example, in Japanese Patent Publication No. 42,006/1974. This pencil includes a casing which houses a fixed collet chuck assembly and a movable resilient chuck assembly. The movable assembly is disposed rearwardly of the fixed assembly, and comprises a plurality of resilient arms which normally hold the lead. A ferrule which is connected with an inner cylinder projects from one end of the casing, and is movable rearwardly together with the inner cylinder. When the ferrule is driven rearwardly, the fixed collet chuck assembly releases the lead while the movable assembly releases the lead after it is moved rearwardly together with the inner cylinder. The lead frictionally engages with a resilient packing which is disposed within the inner cylinder and is urged by the latter through the packing. The inner cylinder and the resilient movable chuck assembly move in synchronized relationship. When the ferrule is released, the inner cylinder and the movable assembly return asynchronously, the inner cylinder returning initially followed by a movement of the movable assembly. The time delay causes the inner cylinder to act through its associated resilient packing to advance the lead relative to the movable assembly. Thus, when the resilient chuck assembly grasps the lead and returns to its initial position, the advance of the lead relative to the resilient chuck assembly is converted into an advance of the lead relative to the inner cylinder. When both the inner cylinder and the movable assembly have returned to their original positions, the fixed assembly firmly holds the lead in a known manner.

While the aforedescribed tip-pushed type mechanical pencil operates on a desired principle, the resulting construction is unfortunately complex. Since the lead is advanced by advancing the lead relative to the movable assembly while utilizing the frictional engagement of the packing with the lead, there is uncertainty as to the amount of advance which might result from a slip between the resilient packing and the lead. On the other hand, in this pencil construction, a movable collet chuck assembly which is normally used in a rear end-pushed type mechanical pencil is replaced by the fixed collet chuck assembly, it is difficult to attain a changed design which is suitable for dual use.

SUMMARY OF THE INVENTION

It is an object of the invention to provide a tip-pushed type mechanical pencil which is simple in construction.

It is another object of the invention to provide a tip-pushed type mechanical pencil which provides an accurate advance of the lead.

It is a further object of the invention to provide a dual use mechanical pencil which can be selectively used as a front tip or rear end pushed type.

DESCRIPTION OF THE PREFERRED EMBODIMENT

Figure 1A:
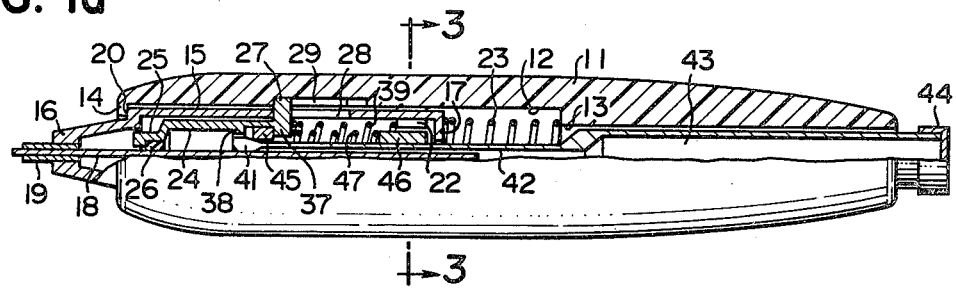
FIGS. 1*a*, 1*b*, 1*c*, 1*d* and 1*e* are a series of side elevations, partly in section, illustrating a sequence of operations of the mechanical pencil constructed according to an embodiment of the invention.
Figure 3:
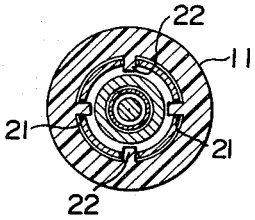
FIG. 3 is a cross section taken along the line 3—3 shown in FIG. 1*a*.

Referring to FIG. 1*a*, there is shown a mechanical pencil according to the invention as it appears in the normal condition. In the description to follow, the left-hand or writing end of the pencil will be referred to as a front end while the opposite or right-hand end will be referred to as a rear end. The pencil includes an outer cylinder 11 which is formed with a first bore 12 of a greater diameter extending axially from its front end to a point substantially at the center of the pencil, and also with a second bore 13 of a reduced diameter and extending in coaxial relationship with a first bore and having its one end communicating with the first bore 12 and its other end opening into the rear end of the cylinder 11. At its front end, the outer cylinder 11 is integrally formed with an annular flange 14 extending from the periphery of the first bore 12 radially inward. An inner cylinder 15 is inserted into the first bore 12 and has an axial length which is less than that of the first bore 12. The inner cylinder 15 carries a hollow conical ferrule 16 at its front end, and is integrally provided with a bottomplate 17 at its rear end which has a central opening. A pencil lead 18 extends through and is protected by a guide tube 19 of a reduced diameter and which is fitted in the front end of the ferrule 16. One end of the guide tube 19 projects forwardly from the ferrule 16. A step 20 is formed between the inner cylinder 15 and the ferrule 16 for engagement with the flange 14 in order to prevent the inner cylinder 15 from projecting out of the outer cylinder 11. Referring to FIG. 3, it will be seen that a plurality of axially extending slits 21 are formed at a suitable angular interval in the rear portion and the bottomplate 17 of the inner cylinder 15 for engagement with lugs 22 extending radially inward from the inner periphery of the outer cylinder 11. The slits are formed in the bottomplate 17 to facilitate the assembly when engaging the lugs 22 with the slits 21 formed in the inner cylinder 15. The combination of the slits 21 and lugs 22 prevents rotation of the inner cylinder 15 relative to the outer cylinder 11. A first coiled spring 23 is received within the first bore 12 for uring the inner cylinder 15 axially forward, whereby the ferrule 16 normally projects out of the front end of the outer cylinder 11.

Figure 4:
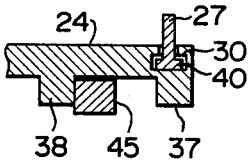
FIG. 4 is a fragmentary enlarged cross section showing the mounting of the detent pin.

A control tube 24 having an axial length less than that of the inner cylinder 15 is fitted into the latter and is integrally formed with an extension tube 25 of a reduced diameter which permits it to extend into the inside of the ferrule 16. Resilient packing 26 is received within the extension tube 25 and resiliently holds the lead 18. A detent pin 27 is rotatably disposed on the outer periphery of the rear part of the control tube 14 and extends radially outward. The detent pin 27 extends through a notch 28 formed in the inner cylinder 15 and engages a recess 29 formed in the inner surface of the first bore 12. Referring to FIG. 4, it will be seen that the detent pin 27 is rotatably mounted on the control tube 24 by securing its lower end to a ring member 40 which rotatably fits in an annular dovetail groove 30 which is formed along the circumference of the rear part of the control tube 24.

Figure 2A:
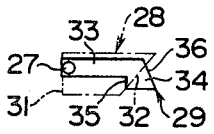
FIGS. 2*a*, 2*b*, 2*c*, 2*d* and 2*e* are schematic views illustrating the relationship of a detent pin relative to a notch and recess in each phase corresponding to FIGS. 1*a* to 1*e*.

As shown by phantom line in FIG. 2*a*, the notch 28 extends axially of the outer cylinder 11, and has a front edge 31 which extends perpendicular to the axis thereof and a rear edge 32 having a cam surface which is inclined relative to the axis. As shown in solid line in FIG. 2*a*, the recess 29 has a rectilinear portion 33 extending axially of the inner cylinder 15 and a detent 34 which is adapted to engage and lock the detent pin 27. The detent 34 has a stepped edge 35 which extends in a direction perpendicular to the axis and a cam edge 36 which is inclined to intersect with the rear edge 32 of the notch 28. The purpose of the notch 28 and the recess 29 is to permit a delayed return of the control tube 24 with respect to the returning movement of the inner cylinder 15 when an axial force applied to the ferrule 16 is removed. The detailed construction of these parts is disclosed in the Japanese Patent Publication cited above.

A pair of axially spaced annular ribs 37, 38 are formed on the inner periphery at the rear part of the control tube 24, the rib 37 being located rearwardly than the other rib 38. A second coiled spring 39 is disposed between the rib 38 and the lugs 22 on the outer cylinder 11 for urging the control tube 24 forwardly. A collet chuck assembly 41 of a known construction is received within the control tube 24 and is connected with a lead passage tube 42 which extends through the inner cylinder 15 and extending into the first bore 12 of the outer cylinder 11. The lead passage tube 42 is connected with a lead storage tube 43 which contains spare leads and which is fitted into the second bore 13 of the outer cylinder 11. The lead storage tube 43 has a sufficient axial length to ensure that its rear end always projects out of the rear end of the outer cylinder 11. A cap 44 is detachably mounted on the projecting end, and spare leads can be inserted into the tube by removing the cap 44. Lead 18 is fed from the tube 43 into the tube 42 by gravity when the pencil is held vertically. As is well known, the chuck assembly 41 has a bevelled outer peripheral surface which slidably receives a chuck ring 45, which is slidably disposed between the ribs 37, 38 of the control tube 24. On its outer periphery, the lead passage tube 42 is formed with a spring abutment 46, and a third coiled spring 47 is disposed between the abutment 46 and rib 37 to urge the chuck assembly 41 and the control tube 24 in opposite directions to achieve a normal engagement of the chuck assembly 41 with the chuck ring 45. The resilience of the third spring 47 is smaller than that of the first spring 23.

In operation, the pencil is shown in FIG. 1*a* when the lead 18 projects out of the guide tube 19 and the pencil can be used for writing. The first and the second springs 23, 29 urge the detent pin 27 to a first position shown in FIG. 2*a* where it is located within the notch 28 and the recess 29, or more specifically, where it engages the front edge 31 of the notch 28 and the front edge of the rectilinear portion 33 of the recess 29. The third spring 47 causes the chuck assembly 41 to engage the chuck ring 45 so that the chuck assembly 41 firmly grasps the lead 18. Consequently, retraction of the lead 18 during the writing process is prevented.

Figure 1B:
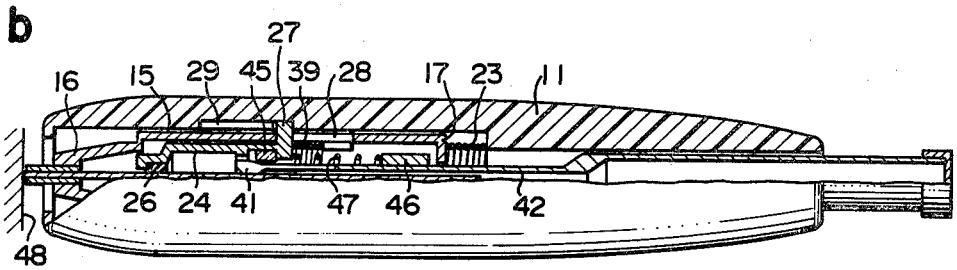
Figure 2B:
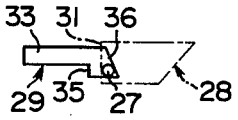
Figure 2C:
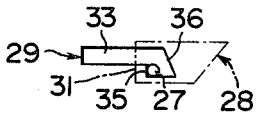

As the lead 18 is exhausted or broken thereby disabling the writing process, the guide tube 19 may be pressed against a writing surface 48 as shown in FIG. 1*b*, thus retracting the inner cylinder 15 against the resilience of first and second springs 23, 39. Thereupon, the detent pin 27 moves rearwardly along the rectilinear portion 33 of the recess 29 as it is driven by the front edge 31 of the notch 28 as shown in FIG. 2*b*. After abutting against the cam edge 36 of the recess 29, it moves angularly along the surface of the cam edge 36 until the position shown in FIG. 2*b* is reached. Since the control tube 24 moves rearwardly together with the detent pin 27, it acts through the third spring 47 to drive the lead passage tube 42 together with chuck assembly 41 and lead storage tube 43 rearwardly through a distance which corresponds to the distance of movement of the control tube 24. However, the resilience of the third spring 47 remains unchanged, so that the lead 18 continues to be held firmly by the chuck assembly 41.

Figure 1C:
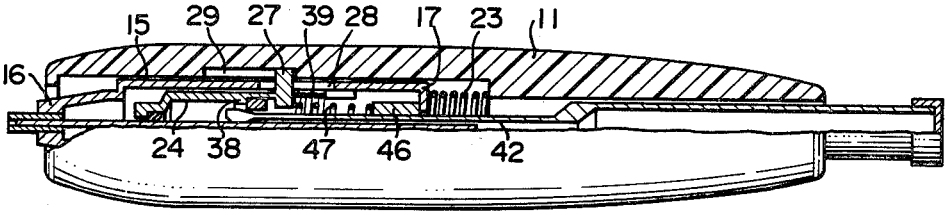
Figure 1D:
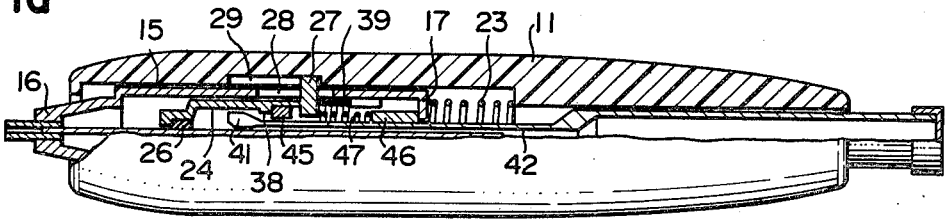

When the guide tube 19 is then released or moved away from the writing surface, the second spring 39 returns the control tube 24 forwardly, and the detent pin 27 which is connected therewith is advanced from its second position within the recess 29 to its third position engaging the stepped edge 35 where the control tube 24 comes to a stop. In the meantime, the control tube 24 drives the chuck ring 45 forwardly through its rear rib 37, so that the ring 45 and its associated assembly including chuck 41, lead passage tube 42 and lead storage tube 43 are driven forwardly. In this manner, the lead 18 is driven forward together with chuck 41 through a distance which is equal to the distance travelled by the detent pin 27 when moving from its position shown in FIG. 2*b* to its position engaging the stepped edge 35 of the recess 29. As a consequence, there occurs no relative movement between the lead 18 and the control tube 24. On the other hand, the inner cylinder 15 is returned to its original position under the resilience of the first spring 23 independently from the described process. During such interval, the bottomplate 17 of the inner cylinder 15 bears against the spring abutment 46 on the lead passage tube 42, causing the assembly including the chuck 41 to move forwardly. As shown in FIG. 1*c*, the chuck 41 moves together with the ring 45 until the chuck ring 45 bears against the front rib 38 on the control tube 24 during the time the latter remains stationary, so that the chuck 41 causes a slight advance of the lead 18 relative to the control tube 24. The amount of such advance is equal to the amount of movement of the chuck ring 45 between the rear and the front ribs 37, 38 on the control tube 24.

Figure 1E:
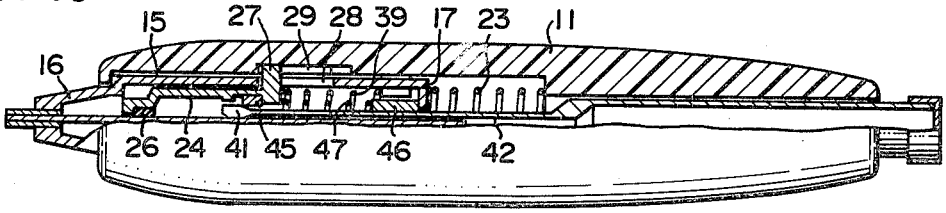
Figure 2D:
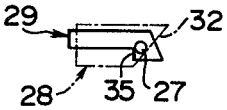
Figure 2E:
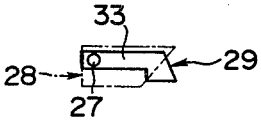

The inner cylinder 15 is further driven forward by the first spring 23, with the consequence that the inner cylinder 15 causes a further advance of the chuck 41 together with the lead passage tube 42 despite the fact that the control tube 24 remains at rest. The movement of the chuck ring 45 is stopped by the front rib 38 of the control tube 24, as shown in FIG. 1*b*, so that the chuck 41 is disengaged from the chuck ring 45 as it is advanced, and thus releases the lead 18. On the other hand, as the inner cylinder 15 advances, the detent pin 27 engages the rear cam edge 32 of the notch 28 as shown in FIG. 2*d*. The detent pin 27 then angularly moves along the cam edge 32 in the opposition direction from before, and is disengaged from the stepped edge 35 of the recess 29 and driven onto the rectilinear portion 33 of the recess 29. As the detent pin 27 moves into the region of the rectilinear portion 33 of the recess 29, the tube 24 which has been maintained stationary begins to move forward again under the resilience of the second spring 39. As the control tube 24 moves forward, the lead 18 is carried forward thereby as shown in FIG. 1*e* while being grasped by the packing 26 received within the extension tube 25 which is integral with the control tube 24. Since the chuck 41 is not released, the lead 18 is advanced by the same distance relative to the chuck 41 as it was advanced before relative to the control tube 24. As the control tube 24 further advances, the chuck ring 45 engaging the rear rib 37 thereof operates to close the chuck 41, which therefore moves forward together with the control tube 24 against the resilience of the second spring 39 while firmly grasping the lead 18. In this manner, it returns to the position shown in FIGS. 1*a* and 2*a* where the lead 18 projects out of the guide tube 19 to enable a writing process to be carried out with the pencil.

The above description covers the manner of feeding the lead 18 forward by pressing the tip of the mechanical pencil against a writing surface. However, it will be noted that the described embodiment is constructed such that the rear end of the lead storage tube 43 projects out of the rear end of the outer cylinder 11 in the normal condition shown in FIG. 1*a*, so that it is also possible to feed the lead 18 forward by axially pressing the cap 44 on the tube 43 in a similar manner as in a mechanical pencil of rear end-pushed type. Specifically, when the cap 44 is pushed, the lead storage tube 43, the lead passage tube 42 and the chuck assembly 41 including the chuck ring 45 are moved forwardly against the resilience of the third spring 47, whereby the chuck 41 feeds the lead 18 forward until the latter is released by the abutment of the chuck ring 45 against the front rib 38 on the control tube 24. Subsequently, when the cap 44 is released, the chuck assembly 41 is returned by the third spring 47 but the chuck assembly 41 does not grasp the lead 18 until the chuck ring 45 abuts against the rear rib 37 on the control tube 24. In the meantime, the lead 18 is held by the resilient packing 26, with the result that the lead 18 is fed forward through a distance which is substantially equal to the amount of movement of the chuck ring 45 between the front rib 38 and the rear rib 37 provided on the tube 24.

It is to be noted that while not shown to simplify the illustration, the outer cylinder 11 is in two parts which are joined together in the region of the recess 29. Similarly, the inner cylinder 15 is joined in the region of the notch 28 and the control tube 24 in the region between the ribs 37, 38. The lead passage tube 42 and the lead storage tube 43 are joined together at their interface.

Figure 5:
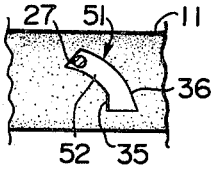
FIG. 5 is a plan view showing another form of the recess.

FIG. 5 shows another form of the recess formed in the outer cylinder 11. In this embodiment, a recess 51 has a rectiliner portion 52 which extends in a helical form along the surface of the outer cylinder 11, thereby providing a buffering action as the detent pin 27 is returned.

Figure 6:
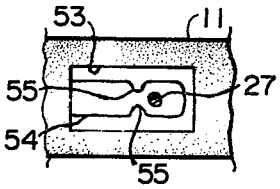
FIG. 6 is a plan view of a further form of the recess.

FIG. 6 shows a further form of the recess formed in the outer cylinder 11. In this instance, an axially elongate rectangular recess 53 is formed in the inner surface of the outer cyliner 11, and a leaf spring 54 which is substantially horseshoe-shaped is received therein. A pair of tabs 55 are formed on the opposite limbs of the leaf spring 54 and are spaced apart by a distance which is slightly less than the diameter of the detent pin 27. The tabs 55 correspond to the stepped edge 35 of the recess 29 in the preceding embodiment. Thus, the tabs define a detent. In this instance, the cooperating notch formed in the inner cylinder 15 may be rectangular in configuration, having no inclined cam edge. Also, the detent pin 27 may be secured to the control tube 24 without an arrangement to permit its angular movement.

What is claimed is:

1. A tip pushed type mechanical pencil in which a lead is fed forward by pressing the front end of a pencil against a writing surface or the like and then releasing it; comprising an outer cylinder, a first inner cylinder fitted inside the outer cylinder so as to be axially movable and having a ferrule on its front end, first spring means for urging the first inner cylinder to cause the ferrule to project out of the front end of the outer cylinder, a second inner cylinder fitted inside the first inner cylinder to be axially movable and carrying a packing in its front end portion which grasps a lead, the second inner cylinder being adapted to cooperate with the first inner cylinder for movement therewith as the latter moves in a direction away from the front end, second spring means for urging the second inner cylinder towards the front end, delay means for moving the second inner cylinder towards the front end in delayed relationship with respect to the movement of the first inner cylinder as a force which urges the first inner cylinder to move away from the front end is removed, a lead passage tube fitted within the second inner cylinder for axial movement and carrying a chuck assembly on its forward end, the lead passage tube being adapted to cooperate with the movement of the first inner cylinder toward the front end for movement in the same direction, third spring means for urging the lead passage tube in a direction away from the front end, and a chuck ring slidably mounted within the second inner cylinder.

2. A tip pushed type mechanical pencil according to claim 1 in which the first inner cylinder has a bottomplate at its rear end which is formed with a central opening for passing the lead passage tube, the lead passage tube being formed with an abutment on its outer periphery in a region thereof located within the first inner cylinder for engagement with the bottomplate, the third spring means being disposed between the rear end of the second inner cylinder and the abutment.

3. A tip pushed type mechanical pencil according to claim 1 or 2 in which the rear end of the lead passage tube projects out of the outer cylinder and having an opening on which a cap member is detachably mounted.

4. A tip pushed type mechanical pencil according to claim 1 in which the rear portion of the lead passage tube is formed as a container for containing a plurality of the leads, the container projecting out of the rear end of the outer cylinder and being provided with an open rear end on which a cap member is detachably mounted.

5. A tip pushed type mechanical pencil according to claim 1 in which the chuck ring is adapted to move between a first circumferential projection on the rear end of the second inner cylinder and a second circumferential projection which is spaced from the first projection toward the front end..

6. A tip pushed type mechanical pencil according to claim 1 in which said delay means comprises a detent pin disposed around the rear end of the second inner cylinder to be angularly movable around the circumference thereof, a notch formed in the wall of the first inner cylinder and extending axially thereof and through which the detent pin extends, and a recess formed in the inner surface of the outer cylinder and extending axially thereof and adapted to be engaged by the free end of the detent pin, the notch having a front edge which extends in a direction perpendicular to the axis of the outer cylinder and having a rear cam edge which inclined with respect to the axis, the recess having a rectilinear portion which extends parallel to the axis, a bevelled edge which is formed at the rear end of the rectilinear portion and intersecting with the rear cam edge at an angle, and a stepped edge formed on the rectilinear portion at a spacing from the bevelled edge for blocking a movement of the detent pin toward the front end, there being a space between the stepped edge and the bevelled edge, whereby the movement of the detent pin follows a path which extends from the rectilinear portion through the bevelled edge and the stepped edge to the rectilinear portion.

7. A tip pushed type mechanical pencil according to claim 6 in which the rectilinear portion of the recess is formed in a helical form in the inner surface of the outer cylinder to provide a buffering action to the movement of the detent pin in the region of the rectilinear portion.

8. A tip pushed type mechanical pencil according to claim 1 in which said delay means comprises a detent pin disposed on the outer periphery of the rear end of the second inner cylinder, a notch formed in the wall of the first inner cylinder to extend axially thereof and through which the detent pin extends, and a recess formed in the inner surface of the outer cylinder to extend axially and engaged by the free end of the detent pin, the recess including an axially elongate rectangular groove, a leaf spring being disposed to extend axially within the groove and having projections toward its rear end which resiliently lock the detent pin, the detent pin moving past the projections by spreading it apart as it is moved toward the front end by the action of a rear cam edge of the notch.

9. A tip pushed type mechanical pencil comprising a cylindrical casing having an opening at least in one end thereof, an inner cylinder fitted inside the casing to be axially movable and carrying a ferrule on its one end which has an opening through which a lead extends, a first spring for urging the inner cylinder toward said one end of the casing so that the ferrule normally projects out of said one end of the casing, a control cylinder fitted inside the inner cylinder to be axially movable, therein the control cylinder being provided with a packing member of a resilient material capable of holding the lead by frictional engagement therewith at one end thereof which is close to the ferrule, the control cylinder being formed with a pair of axially spaced annular ribs on the inner surface at the other end thereof, a second spring for urging the control cylinder toward the one end of the casing, a movable lead supply assembly disposed within the control cylinder and including a ring which is movable between the pair of annular ribs and a collet chuck which cooperates with the ring, the assembly further including a passage tube which extends from the collet chuck through the inside of the inner cylinder toward the other end of the casing, a third spring for urging the lead supply assembly toward the other end of the casing, the third spring being disposed between the control cylinder and the assembly, the collet chuck firmly grasping the lead by its operative coupling with the ring when the latter is located to engage one of the annular ribs which is positioned nearer the other end of the casing, means for controlling the inner cylinder and the control cylinder in a manner such that when a force is applied to the ferrule to urge the ferrule toward the other end of the casing against the resilience of the first spring, the control cylinder is retracted together with the inner cylinder to a predetermined position nearer the other end of the casing against the resilience of the second spring and when the force is removed, the inner cylinder and the control cylinder are returned to their normal positions, with the returning movement of the control cylinder being delayed with respect to that of the inner cylinder, the control cylinder being operative, during its retracting movement, through the third spring to cause the lead supply assembly to be retracted toward the other end of the casing through a distance which is substantially equal to the distance through which the control cylinder is retracted, and means for operatively connecting the inner cylinder with the lead supply assembly and for driving the lead supply assembly toward the one end of the casing against the resilience of the third spring as the inner cylinder is returned from the retracted position to its normal position, the arrangement being such that as the inner cylinder is advanced relative to the control cylinder during the returning movement of the inner cylinder, the inner cylinder drives the lead supply assembly to cause the lead to be advanced relative to the control cylinder and subsequently when the lead supply assembly momentarily releases the lead, the lead is advanced relative to the lead supply assembly by allowing the returning movement of the control cylinder while the packing member holds the lead.

10. A tip pushed type mechanical pencil according to claim 9, further including a container tube communicating with the passage tube and projecting out of the other end of the casing, the container tube containing a plurality of leads.

* * * * *